US008042775B1

(12) United States Patent
Gallegos

(10) Patent No.: US 8,042,775 B1
(45) Date of Patent: Oct. 25, 2011

(54) HEAD AND NECK SUPPORT FOR A SEATED PERSON

(76) Inventor: Juan M. Gallegos, Oakton, VA (US)

( * ) Notice: Subject to any disclaimer, the term of this patent is extended or adjusted under 35 U.S.C. 154(b) by 0 days.

(21) Appl. No.: 12/897,873

(22) Filed: Oct. 5, 2010

(51) Int. Cl.
*A47C 20/00* (2006.01)
*F16M 11/02* (2006.01)

(52) U.S. Cl. ..... 248/118; 248/181.1

(58) Field of Classification Search ..... 248/118, 248/118.1, 118.3, 118.5, 181.1, 279.1, 181.2, 248/288.31, 292.11, 125.8; 403/76, 77
See application file for complete search history.

(56) References Cited

U.S. PATENT DOCUMENTS

| | | | | |
|---|---|---|---|---|
| 646,835 | A * | 4/1900 | Jackson | 248/447.2 |
| 1,260,929 | A * | 3/1918 | Maxcy | 297/394 |
| 1,266,367 | A * | 5/1918 | Wilson | 5/646 |
| 1,894,991 | A * | 1/1933 | Hayes | 108/8 |
| 2,188,514 | A * | 1/1940 | Moore | 248/181.1 |
| 2,459,711 | A * | 1/1949 | Meier | 211/60.1 |
| 3,035,865 | A * | 5/1962 | Schirmer | 297/217.3 |
| 3,380,694 | A | 4/1968 | Branner | |
| 3,687,443 | A * | 8/1972 | Anderson | 269/309 |
| 3,929,309 | A | 12/1975 | De Vore | |
| 4,249,712 | A * | 2/1981 | DeLong | 248/118 |
| 5,303,890 | A | 4/1994 | Carruth | |
| 6,138,970 | A * | 10/2000 | Sohrt et al. | 248/278.1 |
| 6,220,556 | B1 * | 4/2001 | Sohrt et al. | 248/279.1 |
| 6,270,160 | B1 * | 8/2001 | Blake | 297/393 |
| D502,956 | S * | 3/2005 | Holmes et al. | D16/242 |
| 7,048,242 | B2 * | 5/2006 | Oddsen, Jr. | 248/280.11 |
| 7,320,450 | B2 * | 1/2008 | Carnevali | 248/160 |
| 7,380,760 | B2 * | 6/2008 | Dittmer | 248/278.1 |
| 7,523,904 | B2 * | 4/2009 | Carnevali | 248/278.1 |
| 7,748,064 | B2 | 7/2010 | Hamilton | |
| 2008/0121767 | A1 * | 5/2008 | Wimberley | 248/181.1 |
| 2008/0203249 | A1 * | 8/2008 | Priest | 248/118 |

FOREIGN PATENT DOCUMENTS

JP 2002219033 A 8/2002

* cited by examiner

*Primary Examiner* — Alfred J Wujciak, III
*Assistant Examiner* — Ingrid M Weinhold
(74) *Attorney, Agent, or Firm* — Louis Ventre, Jr.

(57) ABSTRACT

A support for the head and neck of a person seated at a desk. The support is adjustable in three dimensions and includes a base, a joint removably attached to the base in a slidable engagement, a vertical arm configured with an offset vertical axis, a ball joint, a chin mount adapted to rotate on the ball joint, a hand-turnable bolt configured to prevent rotation of the chin mount on the spherical ball.

4 Claims, 8 Drawing Sheets

HEAD AND NECK SUPPORT FOR A SEATED PERSON

TECHNICAL FIELD

In the field of devices intended to receive a portion of the human body in sitting position for the purpose of repose.

BACKGROUND ART

Devices supporting a person's head and neck are known. For example, such devices have been used to enhance the reading experience, for supporting the head of a person while resting in a reclining or substantially prone position, and for beauty shop patrons while sitting under a fixed hair dryer and for supporting a person in a forward leaning seated position. None, however, are light-weight, low profile, easily adjustable, and easily disassembled device suitable for use in a business environment by a person seated at a table or desk (hereinafter "desk"), and continuing to perform clerical tasks.

SUMMARY OF INVENTION

A support for the head and neck of a person seated at a desk is braced by the desk immediately in front of the person. The support is intended to have a low-profile, require little desk surface, be readily adjustable to accommodate the comfort of the user, be quickly and easily removed when desired, and be usable while performing clerical work at the desk.

The support includes a base comprising a planar bottom and a top surface. The planar bottom is adapted for placement near the edge of the table or desk in front of the person seated at said table or desk.

A joint is removably attached to the base in a slidable engagement that permits fast and unencumbered removal of the joint, and components above the joint, from the base. The joint includes a horizontal axle positioned above the top surface of the base. The horizontal axle permits rotation of the components above the joint about the axle.

A vertical arm is attached to the horizontal axle and it includes there portions: a bottom portion, a middle curved portion, and a top portion. The bottom portion is attached at one end to the joint enabling the vertical arm to rotate about the horizontal axle. The other end is attached to the middle curved portion. The middle curved portion is configured with two arcs roughly forming an "s" curve giving the vertical arm an offset vertical axis. The top portion is attached to middle portion at one end, while the other end is configured to define a threaded hole, which will receive a threaded rod to provide a means for vertical adjustment of the top end of the vertical arm.

The support includes a ball joint. The ball joint is to provide a mechanism for adjustment in three dimensions of a chin mount that is mounted on a spherical ball of the ball joint. The spherical ball is mounted atop a shaft, which in turn is mounted on a safety platform. A collar is mounted below the safety platform. A bottom face of the collar is configured to meet flush with the surface of the second end of the top portion. A threaded rod is centrally mounted below the collar, the threaded rod configured to mate with the threaded hole in the top portion of the vertical arm. The threaded rod is adapted to raise and lower the chin mount to a height above the table or desk to position the person's head when resting on the chin mount at approximately the height of such person's head in an unsupported position from the table or desk.

The support includes a chin mount adapted to rotate on the ball of the ball joint. The chin mount is configured to removably engage the ball of the ball joint by sliding onto the ball through a threaded slot configured into the bottom of the chin mount.

The support includes a hand-turnable bolt configured to mate with the threaded slot and adapted to engage the ball to prevent rotation of the chin mount on the ball.

Technical Problem

Clerical workers in an office environment can develop neck muscle fatigue, but have no suitable device for supporting one's head while working. Existing devices typically consume a large area of the desk, are designed for a lowered head position unsuitable for working in a business environment, are too heavy, clumsy and noticeable in operation, are not easily adjustable to accommodate different chair heights and human torso configurations, and are not easily and immediately disassembled suitable for use.

Solution to Problem

The solution is a third arm, that is, an arm-like device that holds a person's head under the person's chin as would be done by a person's real arm. The arm-like device is a support that is slidably disengagable from its base resting at the edge of a desk in front of a person. The arm-like device is adjustable in every dimension. A person rests their chin on a chin mount at the upper end of the arm-like device after adjusting it for maximal comfort while working.

Advantageous Effects of Invention

The invention helps reduce neck muscle fatigue and improve employee efficiency while performing clerical work. Its minimal profile makes it virtually unnoticeable in an office environment. Its adjustability makes it readily adaptable for any size user and enables that user to quickly and easily adjust it for maximal comfort. It is designed for instant disassembly when necessary for business etiquette.

The head and neck support for a seated person is useful to support and bring comfort and massage to a user, reducing the strength required, and reducing the stress associated with holding one's head, neck and trunk in place for lengthy periods of time. The device is adjustable to any high and the shape can be easily changed to conform to the comfort of its user. The device is optionally be constructed with compressible coverings to provide added comfort when used in any orientation.

BRIEF DESCRIPTION OF DRAWINGS

The drawings illustrate preferred embodiments of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments are optionally be utilized and structural, and operational changes may be made, without departing from the scope of the present invention.

Figure 1:
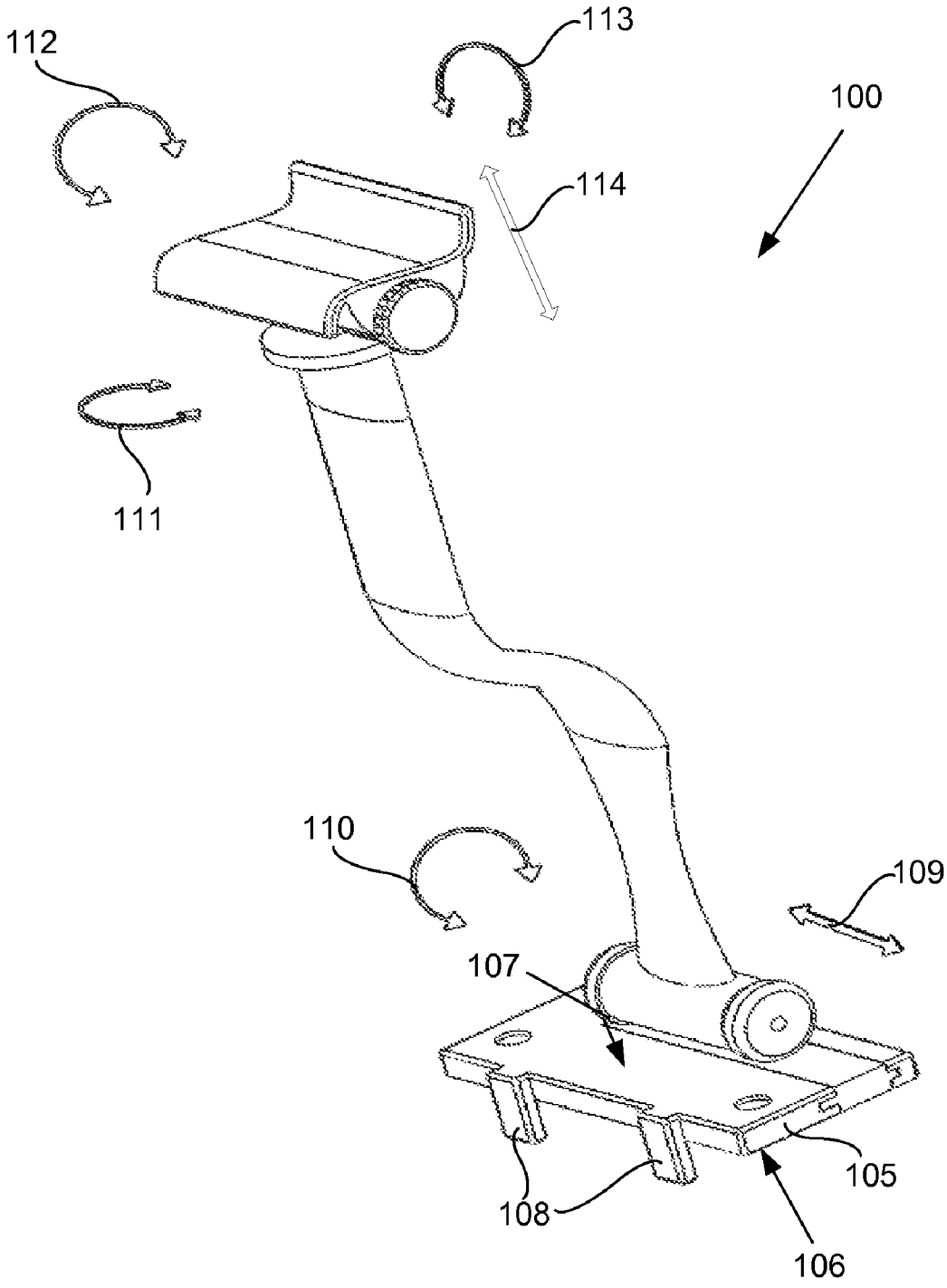
FIG. 1 is a perspective of an assembled support for the head and neck of a person seated at a desk or a table.
Figure 2:
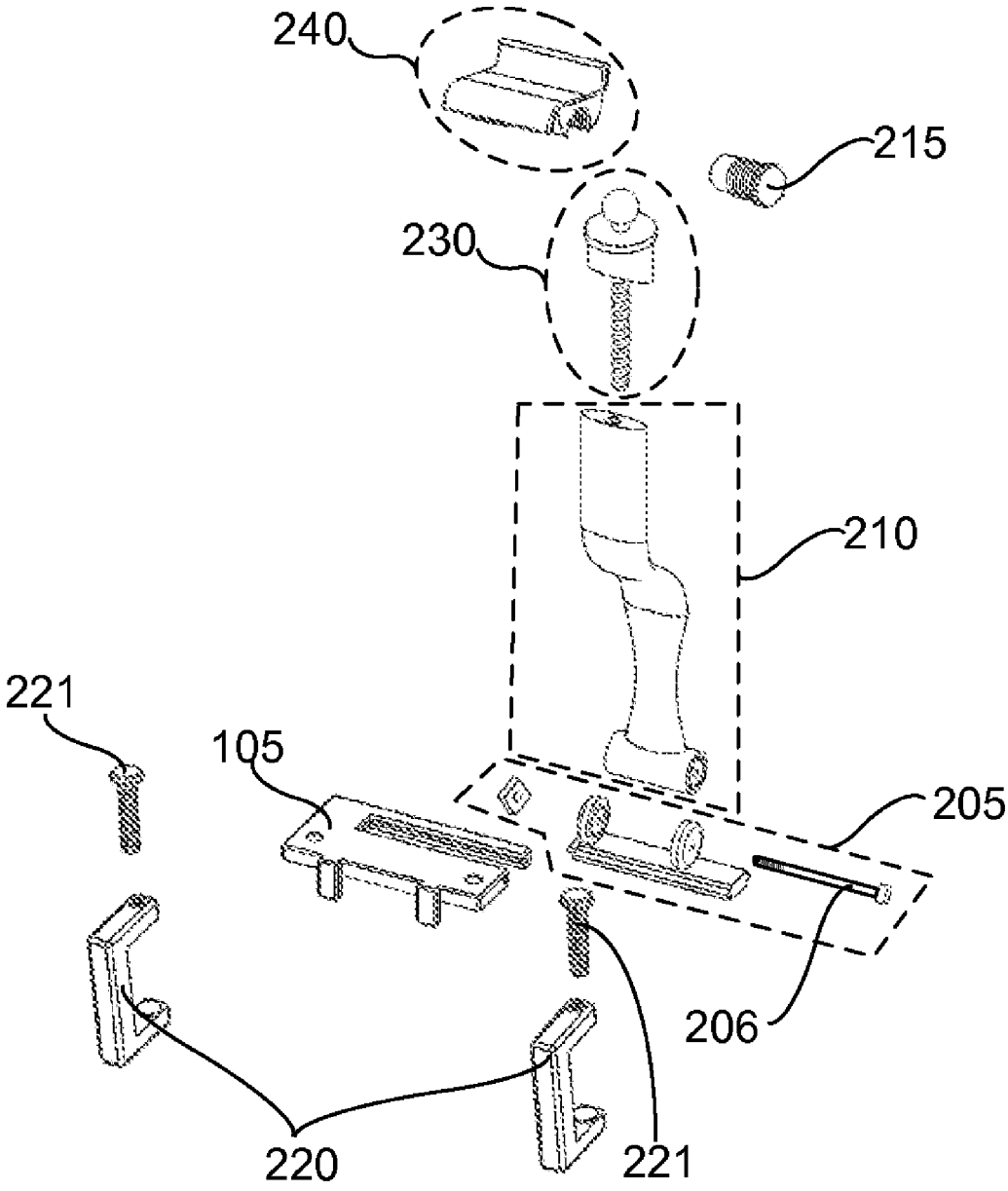
FIG. 2 is an exploded view of the embodiment of FIG. 1.
Figure 8:
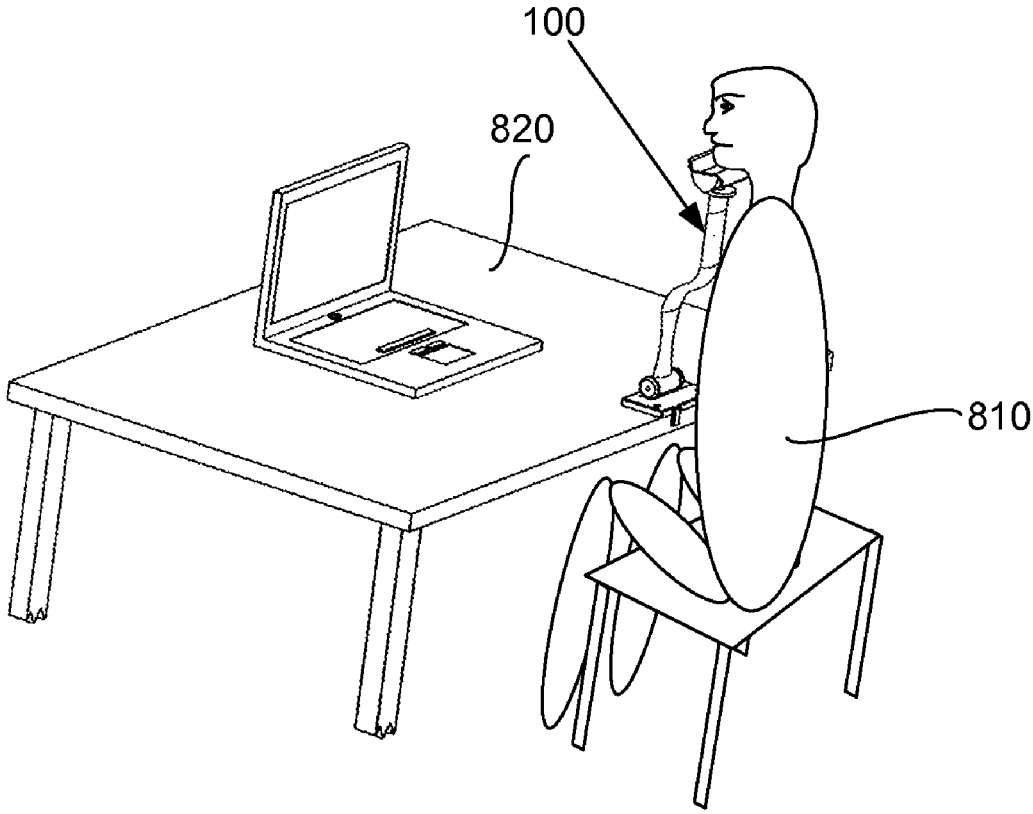
FIG. 8 is an illustration of a figure representing a person seated at a desk using the head and neck support shown in FIG. 1.

FIG. 1 illustrates a preferred embodiment of a support (100) for the head and neck of a person (810) illustrated figuratively in FIG. 8. The person (810) is seated at a desk (820) or a table (hereinafter "desk"). In FIG. 1, the support is assembled. FIG. 2 shows an exploded view with some of the parts more easily discerned. There are 6 parts or components of the support: a base (105), a joint (205), a vertical arm (210); a ball joint (230); a chin mount (240), and a hand-turnable bolt (215).

The support (100) is placed on the desk (820) immediately in front of the person (810). The support (100) is preferably of a small enough profile so that when it is placed in front of the person (810), who is seated, the torso of the person (810) virtually conceals the support (100) from a viewer to the rear of the person (810) so as to provide a discrete means of neck support in a business environment. In addition to its low profile, the support (100) requires little desk surface in front of the user so that it does not interfere with clerical work being performed by the person (810), who is seated. The part of the support (100) that sits on the desk (820) is preferably not more than about three inches by five inches.

Figure 3:
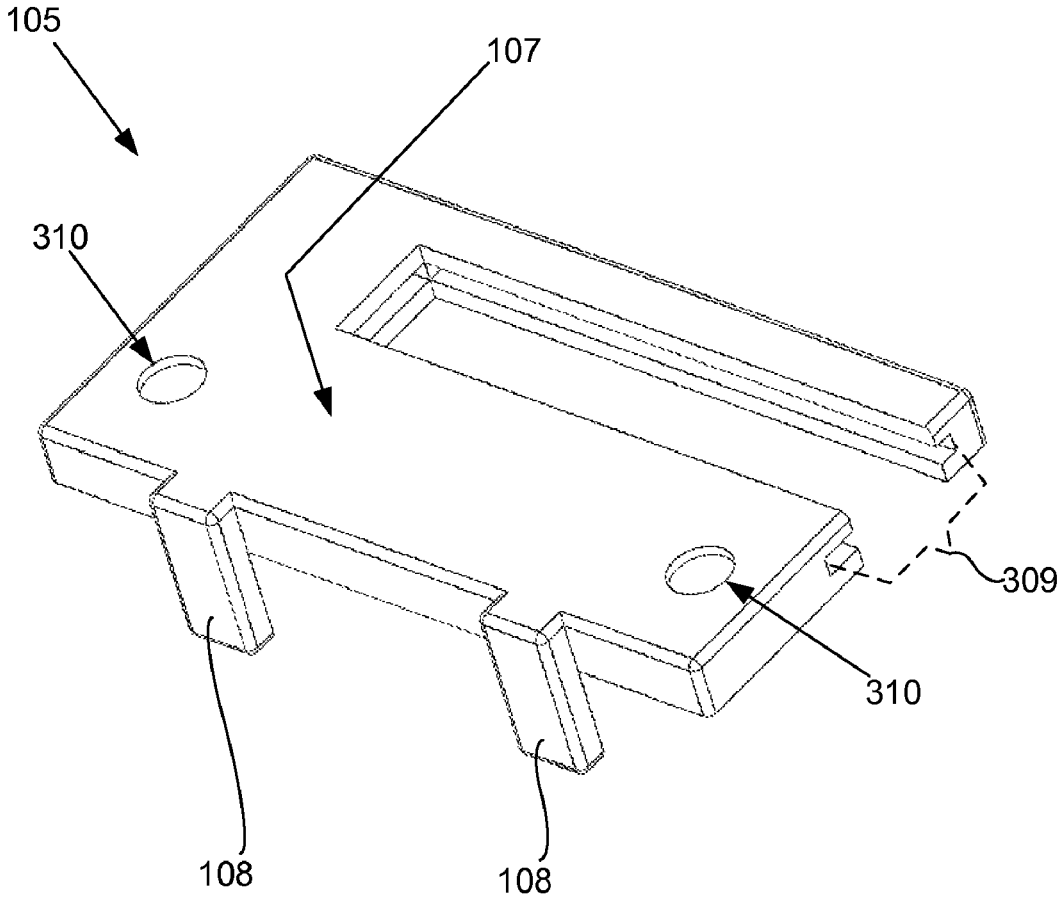
FIG. 3 is a perspective of a base of the head and neck support shown in FIG. 1.

The base (105) is shown in FIG. 1 and FIG. 3. The base (105) comprises a planar bottom (106) and a top surface (107). The base (105) is adapted or configured for placement near an edge of the desk (820) in front of the person (810) seated at the desk (820). Such adaptation or configuration is preferably a flat bottom surface that engages the top of the desk (820). Alternatively, such adaption or configuration is optionally an added rubber or other pad on the planar bottom (106) to increase traction. Alternatively, it is optionally a prong (108), prongs or other shape that extends downwardly from the planar bottom (106) of the base (105) and adapted to engage the edge of the desk (820) so as to inhibit sliding of the base (105) away from the person (810), who is seated, or away from the edge of the desk (820). The base (105) is optionally configured to define with a depression (310), or more than one depression, in the top surface (107). The depression (310) is used to provide a secure point for a C-clamp (220), or two or more C-clamps, to attach the base (105) to the edge of a desk (820). While the C-clamp bolts (221) are shown separately, C-clamps are also well known to have these securing means as an integral part of the C-clamp. In either case, the C-clamp (220) is configured to mechanically attach to the desk (820) at the edge.

Figure 4:
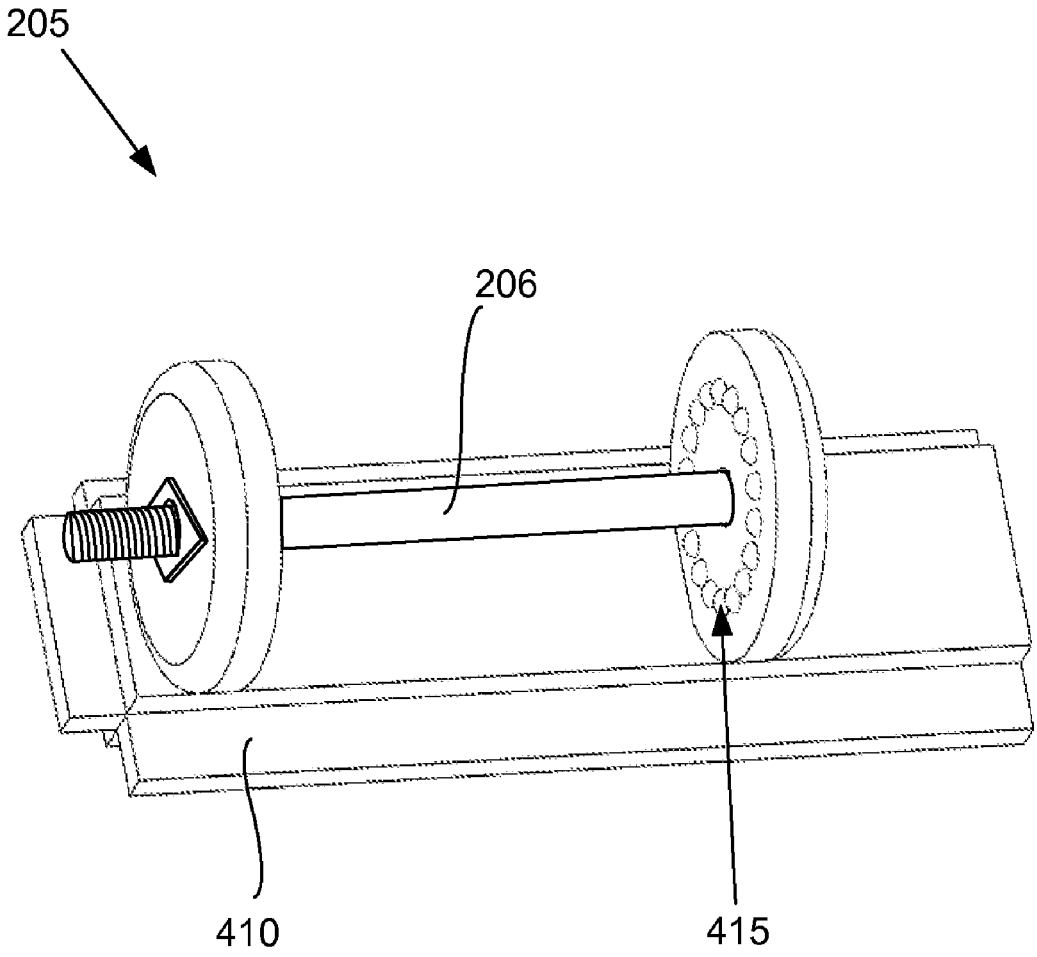
FIG. 4 is a perspective of a joint of the head and neck support shown in FIG. 1.

The joint (205) is shown within the dashed enclosure in FIG. 2 and also in FIG. 4. The joint (205) is removably attached to the base (105) in a slidable engagement enabling movement which is indicated by the first double-headed directional arrow (109). The slidable engagement is preferably a tongue and groove arrangement, with the groove (309) in the base shown in FIG. 3 and the tongue (410) shown in FIG. 4. The groove (309) is represented by the dashed bracket with that reference number designation in FIG. 3.

The joint (205) comprises a horizontal axle (206) positioned above the top surface of the base (105). The horizontal axle (206) is optionally formed from a bolt and nut, as shown in FIG. 2. The joint (205) is optionally configured to include bumps (415) to engage dimples (514) in the vertical arm (210) so that the vertical arm (210) stays at a desired inclination. The horizontal axle (206) enables vertical arm (210) rotation, which is indicated by a second double-headed directional arrow (110).

Figure 5:
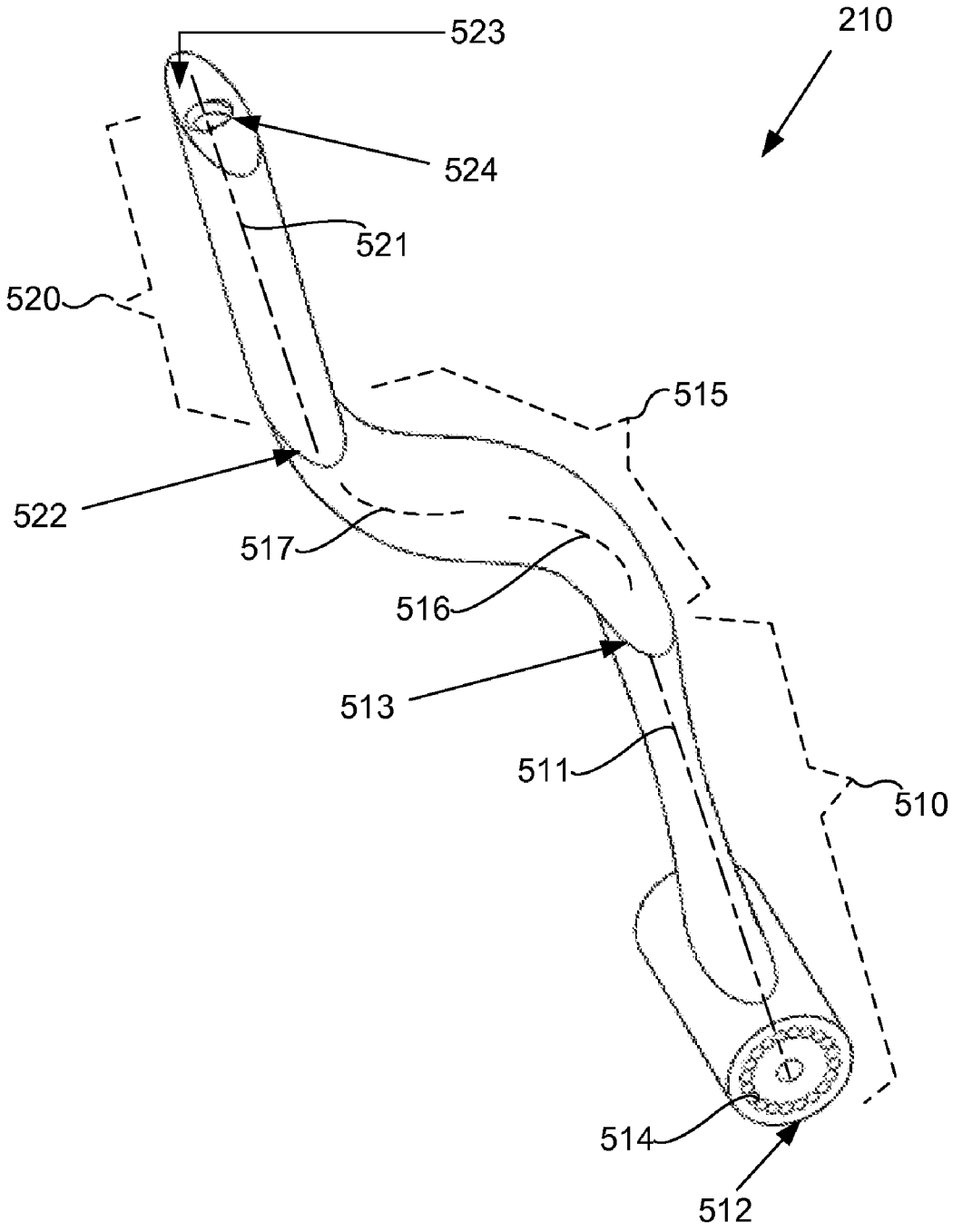
FIG. 5 is a perspective of a vertical arm used in the head and neck support shown in FIG. 1.

The vertical arm (210) is shown within the dashed enclosure in FIG. 2 and also in FIG. 5. The vertical arm (210) comprises three portions: a bottom portion (510), a middle curved portion (515), and a top portion (520).

The bottom portion (510) is configured with a bottom-portion axis (511) that is approximately linear, the bottom portion (510) comprises: a proximal end (512) and a distal end (513). The proximal end (512) is attached to the joint (205) enabling the vertical arm (210) to rotate about the horizontal axle (206). The distal end (513) is attached to the middle curved portion (515).

The middle curved portion (515) is configured with two arcs, a first arc (516) and a second arc (517), to create an offset vertical axis of the vertical arm (210). When the support (100) is in use, the offset vertical axis of the vertical arm (210) enables the top portion (520) to be located closer to the person (810) seated at the desk (820) so that it can be oriented more vertically than might otherwise be the case if the vertical arm (210) had a straight vertical axis. The middle curved portion (515) is optionally bendable by a person (810) to shape the vertical arm (210) to a form more comfortable to the person.

The top portion (520) is configured with a top-portion axis (521) that is approximately linear. The top portion comprises a first end (522) attached to middle portion and a second end (523). The second end (523) is configured to define a threaded hole (524).

Figure 6:
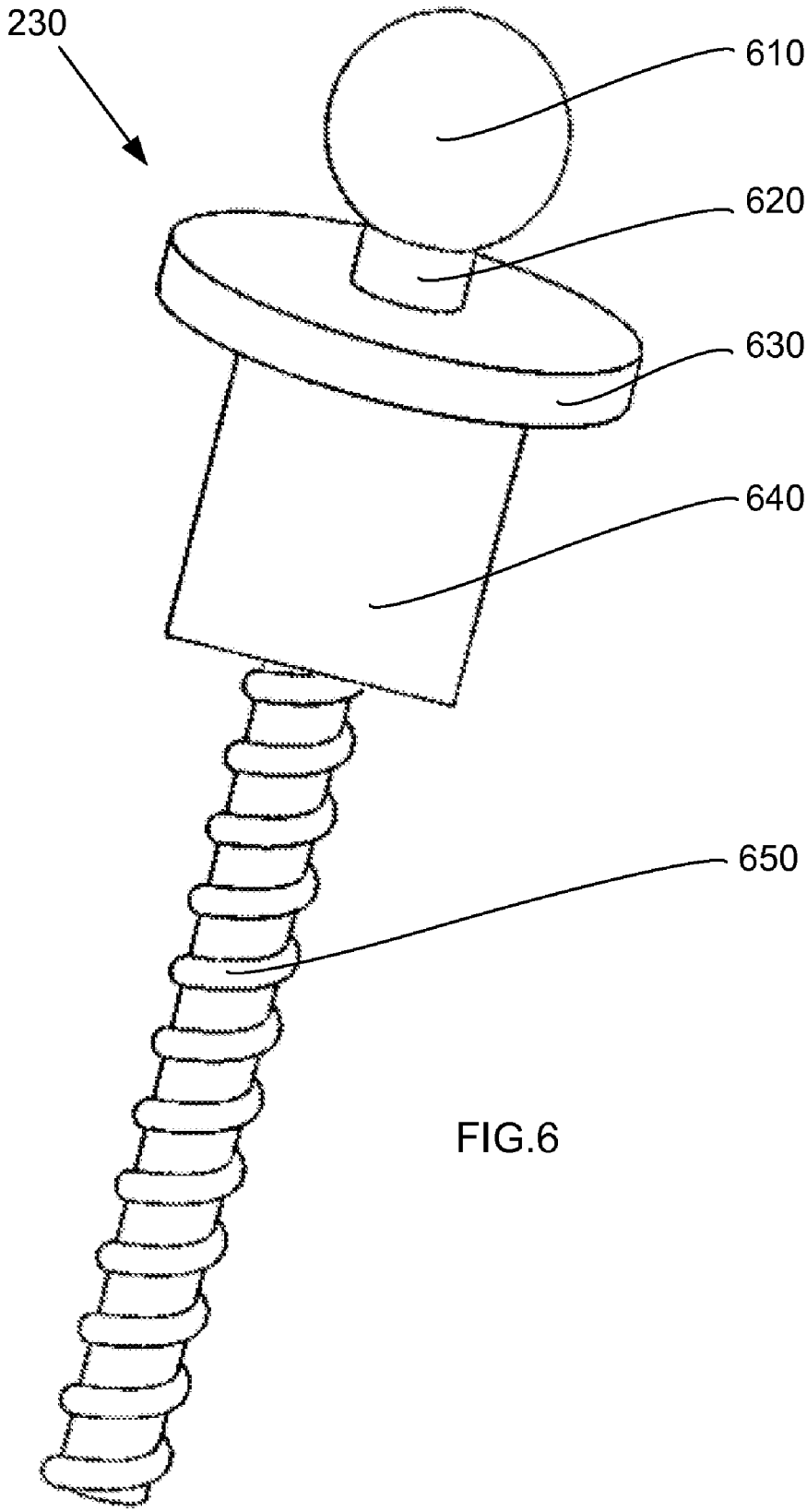
FIG. 6 is a perspective of a ball joint used in the head and neck support shown in FIG. 1.

The ball joint (230) is shown within the dashed enclosure in FIG. 2 and also in FIG. 6. The ball joint (230) comprises a spherical ball (610). The spherical ball (610) comprises a diameter, as is usual for any sphere. The diameter is noted as a relative indicator for the size of the other components of the ball joint (230). The spherical ball (610) permits rotation of the chin mount (240) in three dimensions: a horizontal rotation, represented by a third double-headed directional arrow (111); a front-to-rear rotation, represented by a fourth double-headed directional arrow (112); and a side-to-side rotation, represented by a fifth double-headed directional arrow (113).

The ball joint (230) includes a shaft (620) mounted to the spherical ball (610). The shaft (620) is configured to define a cross-sectional dimension smaller than the diameter of the spherical ball (610).

The ball joint (230) includes a safety platform (630) mounted to the shaft (620). The safety platform (630) extends beyond the diameter of the spherical ball (610). This dimension of the safety platform (630) is important because the chin mount (240) rides on the safety platform to increase frictional resistance after orienting the chin mount (240) for the comfort of the user.

The ball joint (230) includes a collar (640) mounted below the safety platform (630). The collar (640) is configured to mate with the second end (523) of the top portion (520). Preferably, this mating is a flush fit between the bottom surface of the collar (640) and the second end (523).

The ball joint (230) includes a threaded rod (650) centrally mounted below the collar (640). The threaded rod (650) is configured to mate with the threaded hole (524) in the top portion (520) of the vertical arm (210). The threaded rod (650) provides the means to adjust the height of the chin mount (240). This up and down adjustment potential is represented by the sixth double-headed directional arrow (114). Thus, the threaded rod (650) is adapted to raise and lower the chin mount (240) to a height above the desk (820) to position the person's head when resting on the chin mount at approximately the height of such person's head in an unsupported position from the desk (820).

Figure 7:
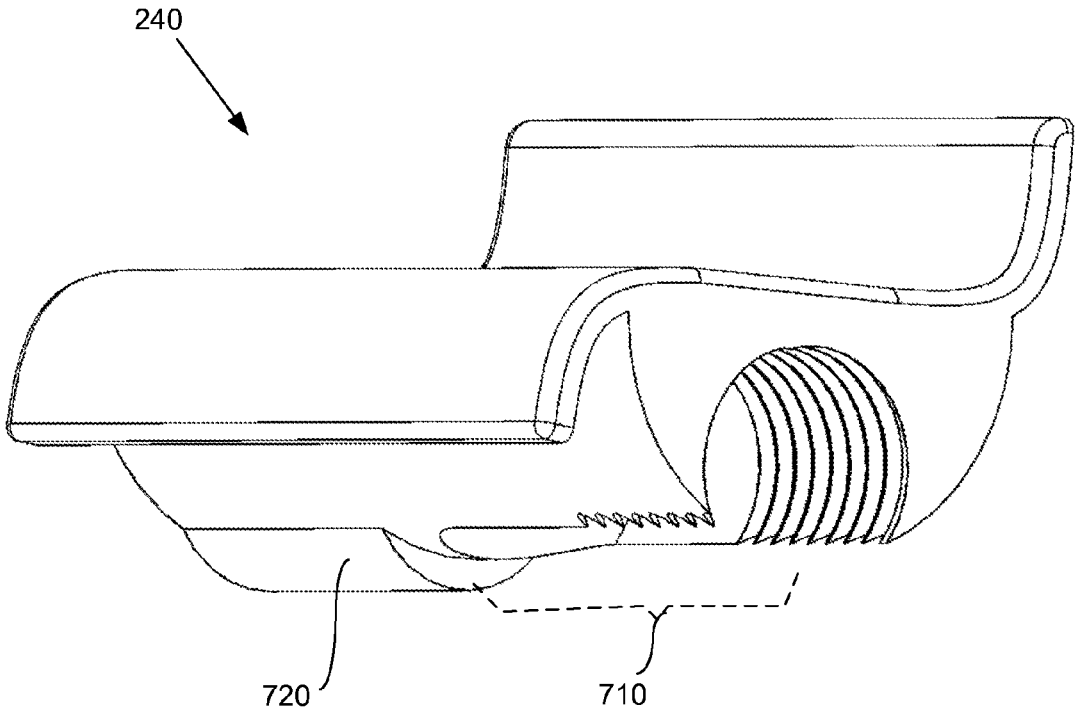
FIG. 7 is a perspective of a chin mount used in the head and neck support shown in FIG. 1.

The chin mount (240) is shown within the dashed enclosure in FIG. 2 and also in FIG. 7. The chin mount (240) is adapted to rotate on the spherical ball (610) of the ball joint (230). The chin mount (240) is configured to removably engage the spherical ball of the ball joint through a threaded slot (710). A friction protrusion (720) rests on the safety platform (630) when the spherical ball (610) of the ball joint (230) is fully inserted into the threaded slot (710) of the chin mount (240). The chin mount (240) is preferable covered with a soft, cushioning material to spread the forces resulting from providing support under a person's chin.

The hand-turnable bolt (215) is configured to mate with the threaded slot (710) of the chin mount (240). The hand-turnable bolt (215) is adapted to engage the spherical ball (610) when tightened to prevent rotation of the chin mount (240) on the spherical ball (610).

The terms "include" and "including" as used herein are intended to be open ended and comparable to the terms "comprise" and "comprising." In this sense, they are intended to be equivalent to "include, but not limited to" "including, but not limited to."

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the office furniture industry.

What is claimed is:

1. A support for a head and neck while a person is seated at a desk, the support comprising:

a base comprising:

a planar bottom adapted for placement near an edge of the desk in front of the person seated at the desk;

a top surface; and the base defining an opening from the planar bottom to the top surface and extending from an edge of the base partially across the base;

a joint removably attached to the base in a slidable engagement with the opening, the joint comprising a horizontal axle positioned above the top surface of the base;

a vertical arm comprising three portions: a bottom portion, a middle curved portion, and a top portion:

the bottom portion having a bottom-portion axis that is approximately linear, the bottom portion comprises: a proximal end and a distal end, the proximal end attached to the joint enabling the vertical arm to rotate about the horizontal axle, the distal end attached to the middle curved portion;

the middle curved portion having two arcs to create an offset vertical axis for the vertical arm;

the top portion having a top-portion axis that is approximately linear, the top portion comprising a first end attached to the middle curved portion and a second end, the second end defining a threaded hole;

a ball joint comprising:

a spherical ball comprising a diameter;

a shaft mounted to the spherical ball, the shaft defining a cross-sectional dimension smaller than the diameter of the spherical ball;

a safety platform mounted to the shaft and in slidable contact with a chin mount, the safety platform comprising a diameter larger than the diameter of the spherical ball;

a collar mounted below the safety platform, the collar configured to mate with the second end of the top portion;

a threaded rod centrally mounted below the collar, the threaded rod inserted into the threaded hole in the top portion of the vertical arm;

the chin mount comprising a friction protrusion that rests on the safety platform when the spherical ball of the ball joint is fully inserted into a threaded slot of the chin mount, the chin mount being rotatably connected on the spherical ball of the ball joint, the chin mount removably engaged with the spherical ball of the ball joint through the threaded slot; and a hand-turnable bolt threadably mated with the threaded slot, the hand-turnable bolt contacts the spherical ball to prevent rotation of the chin mount on the spherical ball.

2. The support of claim 1 wherein the middle curved portion is bendable by the person to shape the vertical arm.

3. The support of claim 1 further comprising a prong extending downwardly from the planar bottom of the base.

4. The support of claim 1 further comprising a C-clamp attached to the base.

* * * * *